US009638073B2

(12) United States Patent
Erickson et al.

(10) Patent No.: US 9,638,073 B2
(45) Date of Patent: May 2, 2017

(54) VALVETRAIN FOR AN ENGINE

(71) Applicant: DEERE & COMPANY, Moline, IL (US)

(72) Inventors: Neil S. Erickson, Denver, IA (US); Christopher L. Bradshaw, Sherrard, IL (US); Richard T. Hurban, Cedar Falls, IA (US); Steven A. Reich, Washoe Valley, NV (US); Micheal A. Langner, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 154 days.

(21) Appl. No.: 14/752,037

(22) Filed: Jun. 26, 2015

(65) Prior Publication Data

US 2016/0376935 A1 Dec. 29, 2016

(51) Int. Cl.

| | |
|---|---|
| ***F01L 1/18*** | (2006.01) |
| ***F01L 1/20*** | (2006.01) |
| ***F01M 9/10*** | (2006.01) |
| *F01L 1/24* | (2006.01) |

(52) U.S. Cl.

CPC ..... *F01L 1/182* (2013.01); *F01L 1/20* (2013.01); *F01M 9/105* (2013.01); *F01L 1/2411* (2013.01); *F01L 1/2422* (2013.01)

(58) Field of Classification Search

CPC ..... F01L 1/182; F01L 1/183; F01L 1/2411; F01L 1/2422

USPC ..... 123/90.43

See application file for complete search history.

(56) References Cited

U.S. PATENT DOCUMENTS

| | | | | |
|---|---|---|---|---|
| 2,209,401 A | | 7/1940 | Jennings, Jr. | |
| 2,532,905 A | | 12/1950 | Hall | |
| 3,147,745 A | * | 9/1964 | Kilgore | F01L 1/2405 123/90.36 |
| 3,301,238 A | * | 1/1967 | Hanley | F01L 1/146 123/90.41 |
| 3,621,823 A | * | 11/1971 | Lombardi | F01L 1/183 123/90.42 |
| 3,667,434 A | * | 6/1972 | Sandusky | F01M 9/107 123/90.35 |
| 4,337,738 A | * | 7/1982 | Bubniak | F01L 13/0005 123/198 F |
| 4,393,820 A | * | 7/1983 | Maki | F01L 1/183 123/90.41 |
| 4,414,935 A | * | 11/1983 | Curtis | F01L 13/0005 123/198 F |

(Continued)

OTHER PUBLICATIONS

MP/Tomahawk-500 Former. Product Brochure [online]. Tomahawk Manufacturing Inc., 2015 [retrieved Nov. 2013]. Retrieved from the Internet: <YRKL http://www.tomahawkmfg.com/content/products/MP500/product.php.

(Continued)

*Primary Examiner* — Jorge Leon, Jr.

(57) ABSTRACT

Valvetrain of an internal combustion engine, including a rocker support, a fulcrum, and a rocker. The rocker support is mounted to a cylinder head and fixed relative thereto. The rocker is positioned about the rocker support and partially in an axial aligning groove of the rocker support. The fulcrum is sandwiched between the rocker support and the rocker. The rocker oscillates about the fulcrum as forces are received and applied to a first and a second end of the rocker.

18 Claims, 5 Drawing Sheets

(56) References Cited

U.S. PATENT DOCUMENTS

| | | | | |
|---|---|---|---|---|
| 4,934,323 | A * | 6/1990 | Grinsteiner | F01L 1/182 123/90.41 |
| 5,038,726 | A | 8/1991 | Pryba | |
| 5,645,025 | A * | 7/1997 | Caya | F01L 1/183 123/193.5 |
| 2002/0017253 | A1* | 2/2002 | Danesh | F01L 1/182 123/90.4 |
| 2008/0202455 | A1* | 8/2008 | Diggs | F01L 1/18 123/90.15 |
| 2009/0044775 | A1* | 2/2009 | Tallio | F01L 1/053 123/90.55 |

OTHER PUBLICATIONS

What is a Valve Bridge on a Cat 3406 B Motor? [online]. Undated. [retrieved Nov. 2013]. Retrieved from the Internet: <URL: http://www.ehow.com/info__12246156__valve-bridge-cat-3406-b-motor.html.

* cited by examiner

VALVETRAIN FOR AN ENGINE

FIELD OF THE DISCLOSURE

The present disclosure relates to a valvetrain for an engine.

BACKGROUND OF THE DISCLOSURE

Diesel engines use a much leaner air-to-fuel ratio than gasoline engines. The larger amount of air in the intake gas promotes more complete fuel combustion and better fuel efficiency, and thus lower emissions of hydrocarbons and carbon monoxide than gasoline engines. However, with the higher pressures and temperatures in the diesel engine, nitrogen oxides emissions, which include nitrogen oxide (NO) and nitrogen dioxide ($NO_2$), known collectively as $NO_x$, tend to be higher because the high temperatures cause the oxygen and nitrogen in the intake air to combine.

To comply with increasingly stringent government mandates regarding $NO_x$ emissions, engine manufacturers have developed several $NO_x$ reduction approaches. One such approach is exhaust gas recirculation (EGR), in which a percentage of the exhaust gas is drawn or forced back into the intake and mixed with the fresh intake gas and fuel that enters the combustion chamber. Another approach is selective catalytic reduction (SCR). The SCR process reduces $NO_x$ to diatomic nitrogen ($N_2$) and water ($H_2O$) using a catalyst and anhydrous ammonia ($NH_3$) or aqueous $NH_3$, or a precursor that is convertible to $NH_3$, such as urea.

In addition to $NO_x$ emissions, diesel engines also produce particulate matter (PM), or soot, which is produced in comparatively larger amounts than that of gasoline engines. PM is a complex emission that includes elemental carbon, heavy hydrocarbons derived from the fuel, lubricating oil, and hydrated sulfuric acid derived from the fuel sulfur. One approach for reducing or removing PM in diesel exhaust is a diesel particle filter (DPF). The filter is designed to collect PM while allowing exhaust gases to pass through it.

These example approaches as well as others may result in, or require, cylinder pressures that are relatively high, as compared to cylinder pressures in systems not using such approaches. These higher cylinder pressures create higher forces, and these higher forces are then applied to the intake and exhaust valves. These forces are then translated to other components in the valvetrain, including the rockers and pushrods, among other things. Such forces may result in failures to these and other components in the valvetrain.

SUMMARY OF THE DISCLOSURE

Disclosed is a valvetrain with a rocker support, a fulcrum, and a rocker. The rocker support is mounted to the cylinder head of an internal combustion engine and is fixed relative thereto. The rocker support includes an axial aligning groove. The rocker is positioned about the rocker support and partially in the axial aligning groove. The fulcrum is sandwiched between the rocker support and the rocker. A first end of the rocker receives forces from and applies forces to a push rod, and a second end of the rocker receives forces from and applies forces to a valve. The rocker oscillates about the fulcrum, as the forces are received and applied to the first end and the second end thereof.

BRIEF DESCRIPTION OF THE DRAWINGS

The detailed description of the drawings refers to the accompanying figures in which.

Like reference numerals in the various drawings indicate like elements.

DETAILED DESCRIPTION OF THE DRAWINGS

Figure 1:
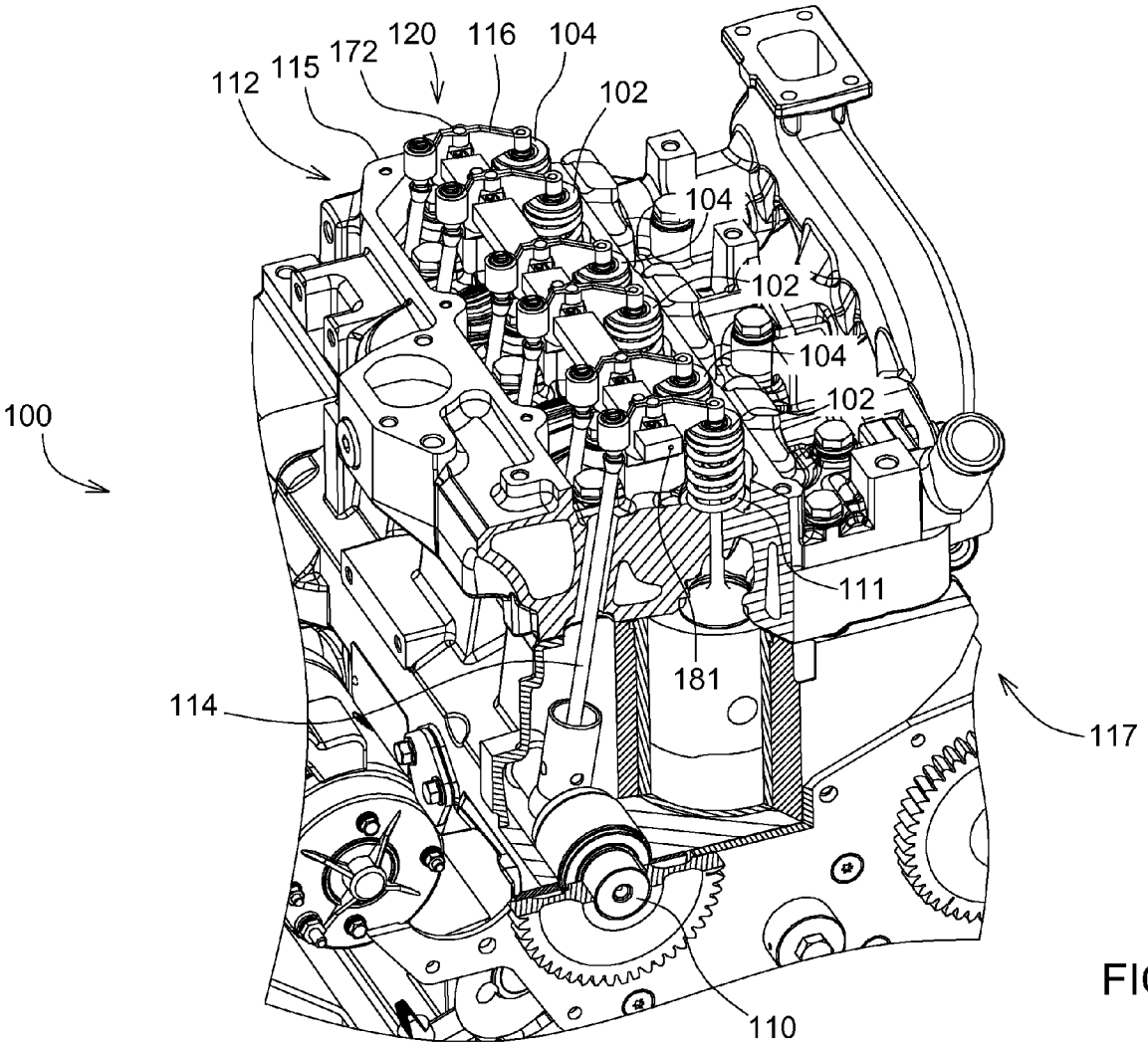
FIG. 1 is a perspective view of an engine and a valvetrain.

Referring to FIG. 1, there is shown a perspective view of an engine 100 that could be used for providing power to a variety of machines, including on-highway trucks, automobiles, marine vessels, stationary generators, construction machinery, agricultural machinery, and recreational vehicles. The engine 100 may be an internal combustion engine, such as a gasoline engine or a diesel engine, and it may be of any size, have any number cylinders, and be of any configuration (e.g., "V," inline, and radial). The engine 100 is shown as having a single intake valve 102 and a single exhaust valve 104 with respect to each cylinder, but other embodiments may have two intake valves and two exhaust valves, for example. In such embodiments, there may be a crosshead used for contacting both the intake valves and exhaust valves and opening them simultaneously.

The engine 100 must receive the intake gas and dispel the exhaust gas at precise intervals using a valvetrain 112. During an intake stroke of a piston, its respective intake valve 102 is generally open, and during an exhaust stroke, the respective exhaust valve 104 is generally open. During the other strokes, both the intake valve 102 and the exhaust valve 104 are generally closed. The valvetrain 112 may include a camshaft 110 that turns at one half of the speed of the crankshaft, so that the intake valves 102 and the exhaust valves 104 are closed once during the two revolutions of the crankshaft. Push rods 114 may be used for providing motion of the camshaft 110 to a rocker 116.

Springs 111 may be positioned around the intake valves 102 and exhaust valves 104, so as to keep them closed until respectively opened by the camshaft 110. The springs 111 may be cylindrical springs, and in some cases, there may be two springs used for each of the valves 102, 104, so as to minimize spring vibration and valve flutter. The springs 111 may be designed based, in part, on the mass of the other components in the valvetrain 112. For example, heavier components may require stiffer, stronger springs 111.

An exhaust system of the engine 100 may include an aftertreatment system for reducing, among other things, particulate matter and $NO_x$. It may include an oxidation catalyst, and a diesel particulate filter (for reducing the particulate matter), and a SCR catalyst (for removing the $NO_x$). A reductant may be injected into the exhaust downstream of the diesel particulate, but upstream of the SCR catalyst. Some examples of the power system may also include an EGR system that reroutes a portion of the exhaust gas (EGR gas) and mixes it with a fresh intake gas, so as to form a mixed intake gas that is combusted in the engine 100. The inclusion of the EGR gas lowers the combustion temperatures and, thus, reduces $NO_x$ levels exiting the combustion chamber.

Referring to FIGS. 1-4, the valvetrain 112 includes a rocker support 120, fulcrum 118, and the rockers 116 for transmitting motion from the camshaft 110 to the intake valves 102 and the exhaust valves 104. The rocker support 120 is mounted to the cylinder head 115 of the engine 100 and is fixed relative thereto, and the cylinder head 115 is mounted to the block 117. The rocker 116 may be a cast component made of, for example, powdered metal.

Each rocker 116 is positioned about the rocker support 120 and is partially in an axial aligning groove 122 of the rocker support 120. The rocker 116 oscillates about the fulcrum 118, as the forces are received and applied to the first and second ends of the rocker 116. The rocker 116 may be made of, for example, 1010, 1018, or 1020 steel that is stamped and then formed, and it may further go through a nitriding or carbonizing process for increasing the strength thereof.

Figure 2:
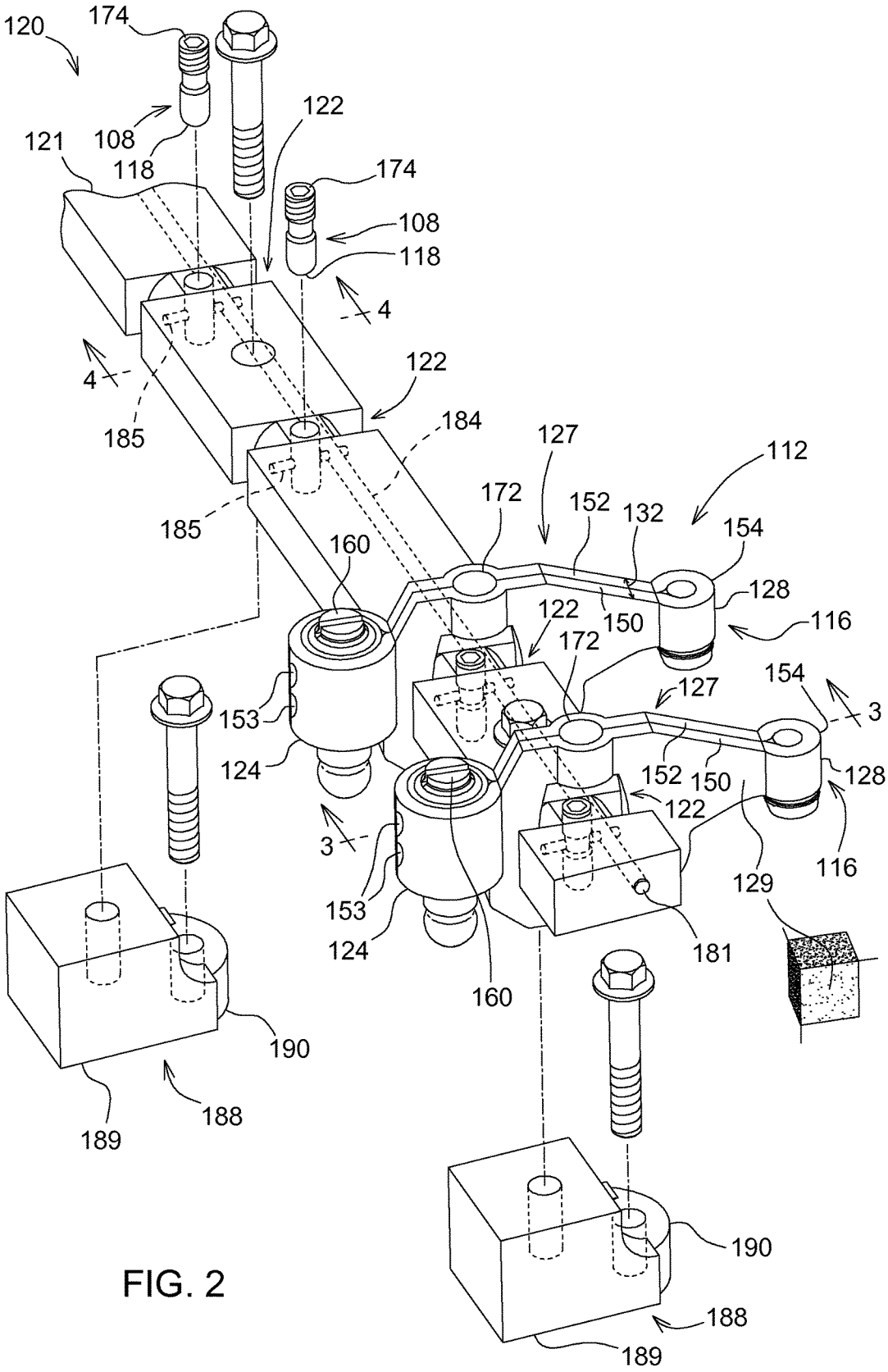
FIG. 2 is a partially exploded perspective view of a portion of the valvetrain.

Referring to FIG. 2, the rocker bar 121 may include a longitudinal lubrication supply passage 184 and a plurality of lateral lubrication supply passages 185 downstream thereof. The passage 184 may be drilled into the rocker bar 121 and have plugs 181 on each end. The passage 184 may receive lubrication exiting the cylinder head 115, and the lateral passages 185 may open into the axial aligning grooves 122 for supplying lubrication to the contact points on the rockers 116.

The rocker 116 may include just a single layer of material or, alternatively, as shown in FIG. 2, a first layer 150 and a second layer 152, both of which may be in contact with one another. The first layer 150 may mirror the second layer 152 with respect to the actuation plane 129. Exemplarily, they may both be made from a single piece of material that is formed so as to define a bend 154 that defines one of the first cylindrical portion 124 and the second cylindrical portion 128. In such an embodiment, opposite of the other of the first cylindrical portion 124 and the second cylindrical portion 128, the first layer 150 and the second layer 152 may be joined by a weld 153 (as is shown) or a cinch, for example. In other embodiments, the first layer 150 and the second layer 152 may be completely separate pieces of material that are then welded to one another, for example.

Figure 5:
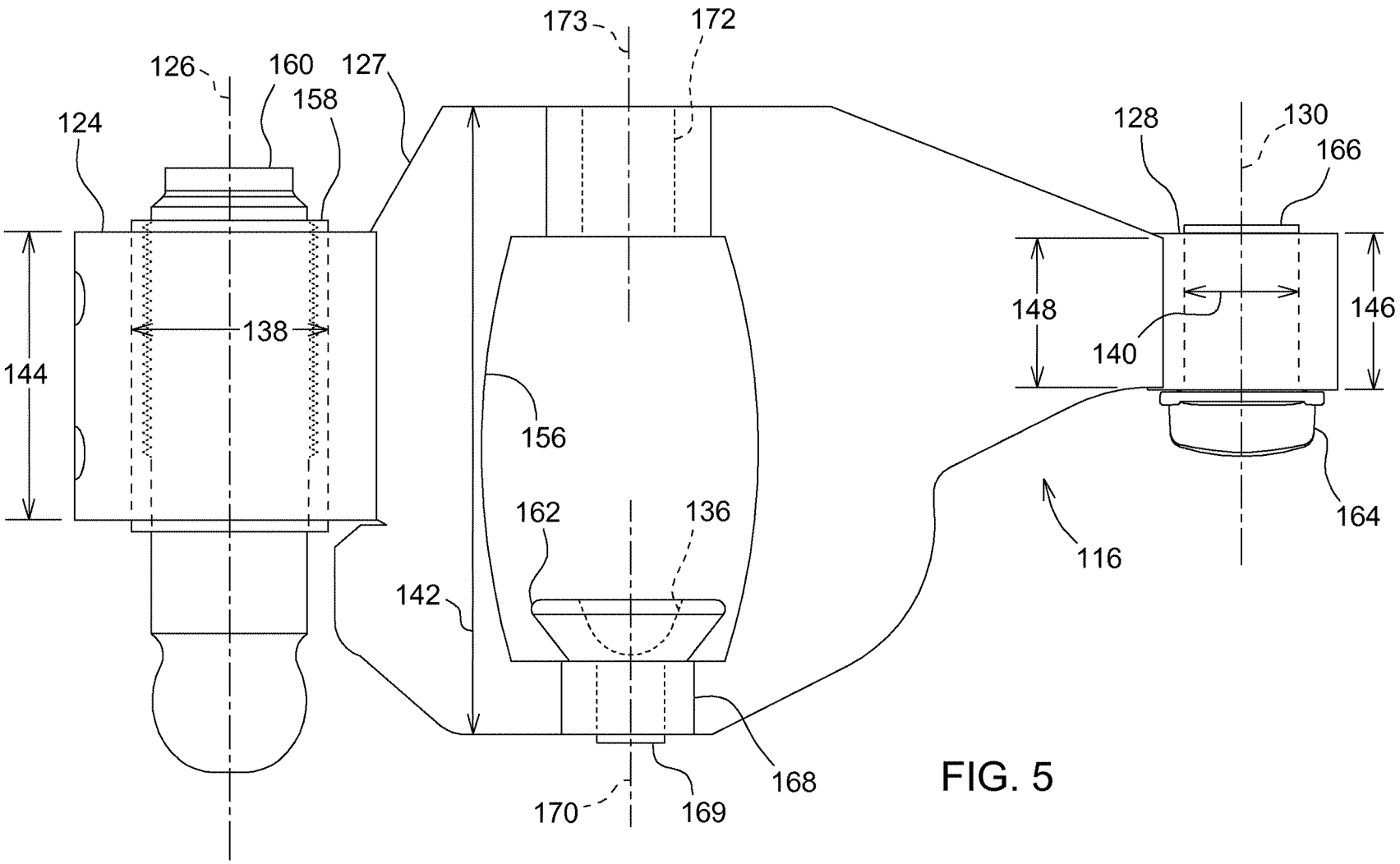
FIG. 5 is an enlarged elevational view of the rocker.

As shown in FIGS. 2 and 5, the rocking plate 127 may include a third cylindrical portion 168 defining a third axis 170, and it may include an installation opening 172 that defines a fourth axis 173. The third axis 170 and the fourth axis 173 may both be aligned with the actuation plane 129. The installation opening 172 may be on an opposite side of an opening 156 as the third cylindrical portion 168.

Figure 3:
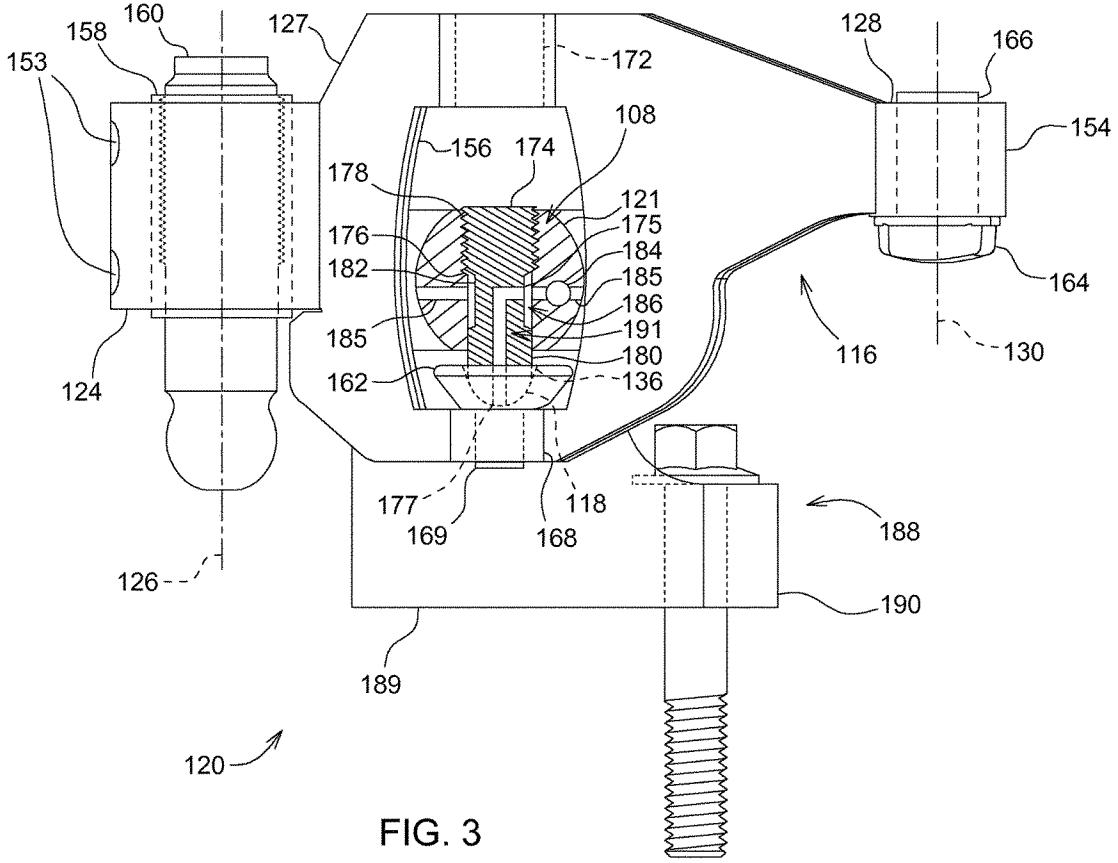
FIG. 3 is a sectional view of the valvetrain taken along lines 3-3 of FIG. 2, showing a rocker and a rocker support.

Referring to FIGS. 2 and 3, the banjo mount 108 is shown having an installation end 174 and the fulcrum 118, the fulcrum 118 being positioned on an end of the banjo mount 108 that is opposite of the installation end 174. The rocker support 120 may include a retaining aperture 176, and the banjo mount 108 may be positioned partially therein. In embodiments of the rocker support 120 that have a rocker bar 121, the rocker bar 121 may include the retaining aperture 176 where the banjo mount 108 may be positioned. The fulcrum 118 may protrude out of a side of the rocker support 120 (e.g., out of the side of the rocker bar 121).

The installation end 174 of the banjo mount 108 may be accessible and positioned on an opposite side of the rocker support 120 (e.g., an opposite side of the rocker bar 121). The installation end 174 may be accessible for assembly and servicing. For example, the installation end 174 may have a hexagonal socket and may be accessible by reaching underneath the rocker 116 with, for example, an allen wrench for tightening and loosening the banjo mount 108. Or, as shown in the illustrated rocker 116, the installation opening 172 may be aligned with the installation end 174 of a banjo mount 108 by, for example, rotating the rocker 116. When aligned, the installation end 174 may be accessible through the installation opening 172 for tightening or loosening the banjo mount 108 with a tool, such as an allen wrench or a screwdriver.

As shown in FIG. 3, for example, the rocker 116 may include a first cylindrical portion 124 that defines a first axis 126 and a second cylindrical portion 128 that defines a second axis 130, the second axis 130 being substantially in alignment with the first axis 126 and spaced apart therefrom. The rocker 116 may further include a rocking plate 127 positioned between the first cylindrical portion 124 and the second cylindrical portion 128. The rocking plate 127 may define an actuation plane 129 (see FIG. 2) that is in alignment with the first axis 126 and the second axis 130, and it may have a substantially consistent thickness 132 as measured in perpendicular relative to the actuation plane 129. The fulcrum 118 may be positioned entirely between the first axis 126 and the second axis 130, and it may be aligned with the actuation plane 129.

The fulcrum 118 is sandwiched between the rocker support 120 and the rocker 116. Exemplarily, the fulcrum 118 may be a sphere (e.g., a ball) or a portion of a sphere, and in such an embodiment, the rocker 116 may include a spherical receiver 136 in contact with the sphere. As another example, the fulcrum 118 may be a cylinder.

As further shown in FIG. 3, the banjo mount 108 may include a banjo lubrication passage 191 that extends through a small diameter portion 182 of the banjo mount 108, a second diameter portion 180, and a fulcrum 118. The small diameter portion 182 may be positioned radially inwards from the retaining aperture 176 and positioned between the first diameter portion 178 and the second diameter portion 180. The second diameter portion 180 may be positioned between the small diameter portion 182 and the fulcrum 118. The small diameter portion 182 and the rocker bar 121 may define a part of a retaining lubrication passage 186. Also as shown in FIG. 3, for example, the rocker bar 121 may also include a retaining aperture 176 that defines a part of the retaining passage 186 positioned downstream from the longitudinal passage 184.

An inlet 175 of the banjo passage 191 may be positioned on an outer surface of the small diameter portion 182, and an outlet 177 may be positioned on an outer surface of the fulcrum 118. In the illustrated embodiment of the valvetrain 112, lubrication flows through the longitudinal lubrication supply passage 184, the retaining passages 186, and out the banjo passages 191. This lubricates the contact points between the fulcrums 118 and the rockers 116. The first diameter portion 178 and the second diameter portion 180 may be positioned in contact with the retaining aperture 176, while the small diameter portion 182 is spaced apart therefrom.

Figure 4:
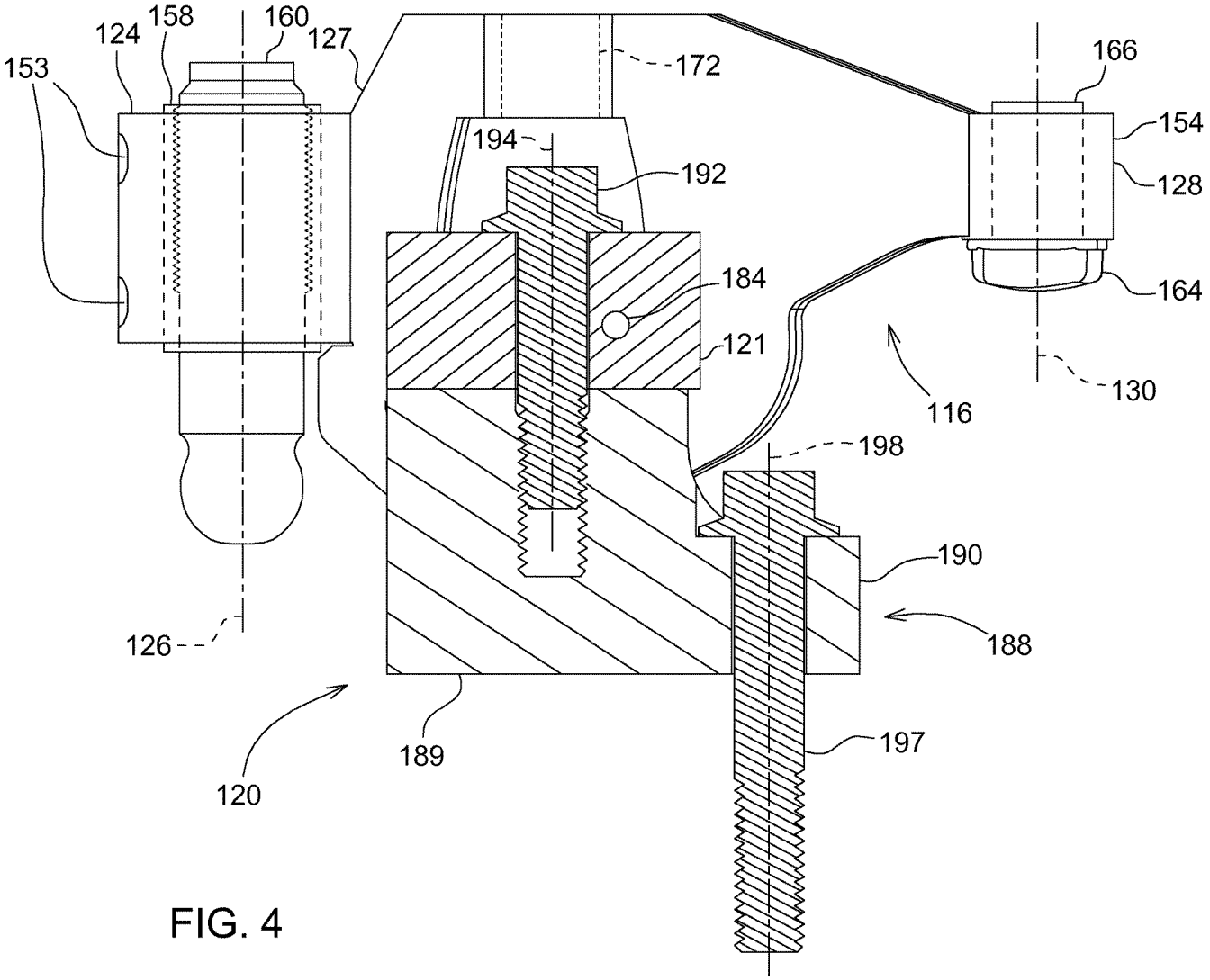
FIG. 4 is a sectional view of the valvetrain taken along lines 4-4 of FIG. 2, showing a rocker and a different portion of the rocker support.

As shown in FIGS. 3-5, the rocker 116 may include an adjustment cylinder 158 positioned in the first cylindrical portion 124 and an adjuster 160 positioned in the adjustment cylinder 158. The adjustment cylinder 158 may be held positioned in the first cylindrical portion 124 with a press fit. The adjustment cylinder 158 and the adjuster 160 may be in threaded engagement with one another. In such an embodiment, the adjuster 160 may be rotated within the adjustment cylinder 158, so as to rotate the rocker 116 about the fulcrum 118 and reposition the rocker 116 relative to the push rod 114. When an intake valve 102 or exhaust valve 104 is properly adjusted, there may be a small clearance, referred to as the "valve lash" or "tappet clearance," between the valve and the rocker 116. The adjuster 160 may be held into position relative to the adjustment cylinder 158 via an interference thread or a jam-nut, for example.

The rocker 116 may also include a tip pad 164 and a pad retaining shaft 166 extending therefrom, wherein the pad retaining shaft 166 may be positioned in the second cylindrical portion 128 and the tip pad 164 may be positioned in contact with either one of intake valves 102 or exhaust valves 104. The tip pad 164 may be made of 52100 chrome alloy steel, having a typical hardness of about 60-67 HRC, and may be held into place in the rocker 116 with a press fit.

The opening 156 may be aligned with the actuation plane 129. The fulcrum 118 and the rocker support 120 may be positioned in the opening 156. The opening 156 of the rocker 116 does not interfere with the rocker support 120 when the valve is in a completely open position, a completely closed position, or any position therebetween.

As shown in FIG. 4, the rocker support 120 may include a rocker bar 121 and a plurality of mounting feet 188. The rocker bar 121 may define the axial aligning grooves 122. Each mounting foot 188 may include a first portion 189 and a second portion 190. The first portion 189 may be sandwiched between the rocker bar 121 and the cylinder head 115, and the second portion 190 may extend laterally outward from the first portion 189 and the rocker bar 121. The rocker bar 121 may be fastened to the first portion 189, and the second portion 190 may be fastened to the cylinder head 115. In such an arrangement, the rocker bar 121 may be mounted to the mounting foot 188 with a first fastener 192 along a first mounting axis 194, and the mounting foot 188 may be mounted to the cylinder head 115 with a second fastener 197 along a second mounting axis 198 that is aligned with, but laterally offset from, the first mounting axis 194.

As shown in the illustrated embodiment of the rocker support 120, the opening 156 is large enough to fit around and slide along the rocker bar 121 when the rocker 116 is being installed. For example, the opening 156 may be aligned with the rocker support 120, then slid into an axial position on the rocker support 120, and then rotated and generally retained in the axial position. As also shown in the illustrated embodiment of the rocker support 120, the opening 156 is not large enough to fit around and slide over the entire length of the rocker bar 121 when the mounting feet 188 are mounted thereto. In such an embodiment, each rocker 116 may be installed prior to having the mounting feet 188 installed.

As shown in FIG. 5, a maximum outer dimension 142 of the rocking plate 127, as measured along the actuation plane 129 (see FIG. 2) and parallel to the first axis 126, may be greater than a length 144 of the first cylindrical portion 124 as measured along the first axis 126. Likewise, the maximum outer dimension 142 of the rocking plate 127 may also be greater than a length 146 of the second cylindrical portion 128, as measure along the second axis 130. Still further, a minimum outer dimension 148 of the rocking plate 127, as measured along the actuation plane 129 and parallel to the second axis 130, may be substantially equal to the length 146 of the second cylindrical portion 128, as measured along the second axis 130. An embodiment of the rocker 116 with such dimensions may be lightweight, yet very rigid, as a result of the relatively large maximum outer dimension 142 within the actuation plane 129.

An inner diameter 138 of the first cylindrical portion 124 may be larger than the thickness of the rocking plate 127, and similarly an inner diameter 140 of the second cylindrical portion 128 may also be larger than the thickness of the rocking plate 127. Such a thickness, which is quite thin relative to both the minimum outer dimension 148 and the maximum outer dimension 142, further adds to a shape that is lightweight and rigid, particularly when viewed in combination with the relatively large maximum outer dimension 142.

Also as shown in FIG. 5, the third axis 170 that may be substantially in alignment with the first axis 126 and the second axis 130, but spaced therebetween and apart therefrom. Further, the third axis 170 may intersect the actuation plane 129 and also the fulcrum 118.

The rocker 116 may include a rocker pivot cup 162 and a cup retaining shaft 169 extending therefrom. The illustrated pivot cup 162 defines the spherical receiver 136. As shown, the cup retaining shaft 169 may be positioned in the third cylindrical portion 168, so that the rocker pivot cup 162 extending therefrom is positioned in contact with the fulcrum 118. The cup retaining shaft 169 may be held into place in the third cylindrical portion 168 with, for example, a press fit. The rocker pivot cup 162 may be made of 52100 chrome alloy steel, having a typical hardness of about 60-67 HRC.

Repositioning the third axis 170 and the fulcrum 118, relative to the first axis 126 and the second axis 130, may be useful for adjusting the force distributions, ratios, and movements in the valvetrain 112. Such adjustments may be easily designed into some embodiments of the rocker 116, while still keeping its shape, functionality, and strength.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A valvetrain of an internal combustion engine, the valvetrain comprising:

a rocker support configured to be mounted to a cylinder head of the internal combustion engine and fixed relative thereto, the rocker support comprising an axial aligning groove;

a fulcrum; and a rocker positioned about the rocker support and partially in the axial aligning groove, the fulcrum being positioned between the rocker support and the rocker, a first end of the rocker configured to receive forces from and apply forces to a push rod, a second end of the rocker configured to receive forces from and apply forces to a valve, the rocker being configured to oscillate about the fulcrum; and a banjo mount comprising an installation end and the fulcrum on an opposite end, the rocker support comprising a retaining aperture, the banjo mount being positioned partially in the retaining aperture, the fulcrum protruding out of a side of the rocker support, and the installation end being accessible and positioned on an opposite side of the rocker support.

2. The valvetrain of claim 1, wherein the rocker comprises:

a first cylindrical portion that defines a first axis;

a second cylindrical portion that defines a second axis, the second axis is substantially in alignment with the first axis and is spaced apart therefrom, the fulcrum is positioned between the first axis and the second axis; and a rocking plate positioned between the first cylindrical portion and the second cylindrical portion, the rocking plate defines an actuation plane that is in alignment with the first axis and the second axis, and the rocking plate has a substantially consistent thickness as measured in perpendicular relative to the actuation plane.

3. The valvetrain of claim 2, wherein an inner diameter of the first cylindrical portion and an inner diameter of the second cylindrical portion are larger than the thickness of the rocking plate.

4. The valvetrain of claim 2, wherein:

a maximum outer dimension of the rocking plate, as measured along the actuation plane and parallel to the first axis, is greater than a length of the first cylindrical portion as measured along the first axis; and the maximum outer dimension of the rocking plate is greater than a length of the second cylindrical portion as measured along the second axis.

5. The valvetrain of claim 2, wherein a minimum outer dimension of the rocking plate, as measured along the actuation plane and parallel to the second axis, is substantially equal to a length of the second cylindrical portion as measured along the second axis.

6. The valvetrain of claim 2, further comprising an adjustment cylinder positioned in the first cylindrical portion and an adjuster positioned in the adjustment cylinder, the adjustment cylinder and the adjuster are in threaded engagement with one another, the adjuster is configured to turn within the adjustment cylinder, so as to rotate the rocker about the fulcrum and reposition the rocker relative to the push rod.

7. The valvetrain of claim 2, wherein the rocker comprises a first layer and a second layer, the first layer being in contact with the second layer, the first layer mirrors the second layer with respect to the actuation plane, the first layer and the second layer are formed by a single piece of material, and the first layer and the second layer define a bend that defines one of the first cylindrical portion and the second cylindrical portion.

8. The valvetrain of claim 2, wherein the rocker comprises a tip pad and a pad retaining shaft extending therefrom, the pad retaining shaft is positioned in the second cylindrical portion, and the tip pad is positioned in contact with the valve.

9. The valvetrain of claim 2, wherein the rocker comprises a first layer and a second layer, the first layer being in contact with the second layer, and the first layer mirrors the second layer with respect to the actuation plane.

10. The valvetrain of claim 2, wherein the rocking plate comprises an opening aligned with the actuation plane, and the fulcrum and the rocker support are positioned in the opening.

11. The valvetrain of claim 10, wherein:

the rocking plate comprises a third cylindrical portion that defines a third axis, the third axis is substantially in alignment with the first axis and the second axis but spaced apart therefrom, the third axis intersects the actuation plane and the fulcrum; and the rocker comprises a rocker pivot cup and a cup retaining shaft extending therefrom, the cup retaining shaft is positioned in the third cylindrical portion, and the rocker pivot cup is positioned in contact with the fulcrum.

12. The valvetrain of claim 11, wherein the rocker support comprises:

a rocker bar defining the axial aligning groove;

a mounting foot comprising a first portion and a second portion, the first portion is sandwiched between the rocker bar and the cylinder head, the second portion extends laterally outward from the first portion and the rocker bar, the rocker bar is fastened to the first portion, and the second portion is fastened to the cylinder head.

13. The valvetrain of claim 12, wherein the rocker bar is mounted to the mounting foot with a first fastener along a first mounting axis, and the mounting foot is mounted to the cylinder head along a second mounting axis that is aligned with, but offset from, the first axis.

14. The valvetrain of claim 12, wherein:

the rocker bar comprises a bar retaining aperture, the banjo mount is positioned in the bar retaining aperture, the fulcrum protrudes out of a side of the rocker bar, and the installation end is accessible and positioned on an opposite side of the rocker bar and away from a cylinder of an engine; and the rocking plate comprises an installation opening that defines a fourth axis, the installation opening is on an opposite side of the opening as the third cylindrical portion, the fourth axis is substantially in alignment with the first axis and the second axis but spaced apart therefrom, and the fourth axis intersects the actuation plane, and the installation opening is aligned with the installation end of the banjo mount.

15. The valvetrain of claim 12, wherein the rocker bar comprises:

a longitudinal lubrication supply passage; and a lateral lubrication supply passage positioned downstream of the longitudinal lubrication supply passage, the lateral lubrication supply passage opens into the axial aligning groove for supplying lubrication thereto.

16. The valvetrain of claim 12, wherein the rocker bar comprises:

a longitudinal lubrication supply passage; and a bar retaining aperture that defines a part of a retaining lubrication passage positioned downstream from the longitudinal lubrication supply passage, the banjo mount is positioned in the bar retaining aperture, the fulcrum protrudes out of a side of the rocker bar, and the installation end is accessible and positioned on an opposite side of the rocker bar and away from a cylinder of the engine.

17. The valvetrain of claim 16, wherein the banjo mount comprises:

a first large outer diameter portion that is positioned in contact with the retaining aperture;

a second large outer diameter portion that is positioned in contact with the retaining aperture; and a small outer diameter portion that is positioned inwards from the retaining aperture and positioned between the first large outer diameter portion and the second large outer diameter portion, the small outer diameter portion defines the part of the retaining lubrication passage, the second large outer diameter portion is positioned between the small outer diameter portion and the fulcrum.

18. The valvetrain of claim 17, wherein the banjo mount comprises a banjo lubrication passage that extends through the small outer diameter portion and the second large outer diameter portion and the fulcrum, and the banjo lubrication passage comprises:

an inlet positioned on an outer surface of the small outer diameter portion; and an outlet positioned on an outer surface of the fulcrum.

* * * * *